US005186816A

United States Patent [19]

Maruyama et al.

[11] Patent Number: 5,186,816

[45] Date of Patent: * Feb. 16, 1993

[54] METHOD OF PRODUCING HIGH AROMATIC-CONTENT SOLVENTS

[75] Inventors: Fumio Maruyama; Shiro Aizawa, both of Toda; Kazuo Fujiyoshi, Tokyo, all of Japan

[73] Assignee: Nippon Mining Co., Ltd., Tokyo, Japan

[ * ] Notice: The portion of the term of this patent subsequent to Oct. 16, 2007 has been disclaimed.

[21] Appl. No.: 492,469

[22] Filed: Mar. 12, 1990

[51] Int. Cl.[5] ..... C10G 35/04; C07C 5/22

[52] U.S. Cl. ..... 208/135; 208/136; 208/138; 585/419; 585/420; 585/800

[58] Field of Search ..... 208/133, 134, 104, 103, 208/47, 137, 65, 135, 136, 138; 585/417, 419, 420, 477, 800, 804, 812, 828

[56] References Cited

U.S. PATENT DOCUMENTS

| | | | |
|---|---|---|---|
| 2,710,826 | 6/1955 | Weikart | 585/420 |
| 2,848,377 | 8/1958 | Webb | 208/139 |
| 2,851,398 | 9/1958 | Gornowski | 208/139 |
| 3,055,956 | 9/1962 | Paulsen | 585/320 |
| 3,153,675 | 10/1964 | Mason | 585/304 |
| 3,249,644 | 5/1966 | Hahn | 585/304 |
| 3,499,945 | 6/1967 | Kirk | 585/434 |
| 3,793,183 | 2/1974 | Mahoney | 208/134 |
| 3,870,745 | 3/1975 | Angstadt | 585/471 |
| 3,890,403 | 6/1975 | Shimado et al. | 585/481 |
| 3,936,509 | 2/1976 | Nagahama et al. | 585/866 |
| 4,000,058 | 12/1976 | Duhaut | 208/139 |
| 4,014,949 | 3/1977 | Hedge | 585/831 |
| 4,174,271 | 11/1979 | Mayes | 208/65 |
| 4,300,008 | 11/1981 | McCaulay | 208/134 |
| 4,536,278 | 8/1985 | Tatterson et al. | 208/89 |
| 4,645,588 | 2/1987 | Buss | 585/419 |
| 4,648,961 | 3/1987 | Jacobsen | 585/419 |
| 4,963,248 | 10/1990 | Yano et al. | 208/135 |

FOREIGN PATENT DOCUMENTS

| | | |
|---|---|---|
| 0124328 | 11/1984 | European Pat. Off. . |
| 0164905 | 12/1985 | European Pat. Off. . |
| 0960164 | 6/1964 | United Kingdom . |

*Primary Examiner*—Margaret Medley
*Attorney, Agent, or Firm*—Oliff & Berridge

[57] ABSTRACT

A high aromatic-content solvent having a boiling point range of 185°-245° C. and a mixed aniline point of not higher than 21° C. is produced by reforming a petroleum fraction containing at least 50% by volume of components having a boiling point range of 150°-215° C. and then subjecting to a fractional distillation.

9 Claims, No Drawings

METHOD OF PRODUCING HIGH AROMATIC-CONTENT SOLVENTS

BACKGROUND OF THE INVENTION

1. Field of the Invention

This invention relates to a method of producing a high aromatic-content solvent from a petroleum fraction containing components having a boiling point of 150°-215° C.

2. Related Art Statement

Fractions each having a boiling point range of 185°-245° C. and mainly composed of aromatic components are used as a solvent or a thinner for thermoset coatings using phenolic resin, alkyd resin, urea resin, melamine resin, acrylic resin or the like, a solvent for cleaning metal parts, an emulsifying agent for agricultural chemicals, an oiliness improver for machines or further a solvent for reaction systems. These solvents are required to have a mixed aniline point of not higher than 21° C., particularly a mixed aniline point of not higher than 18° C. within a boiling point range of 205°-245° C.

Heretofore, the solvent of this type has been produced by a method of recovering from a coal tar oil, a method of mixing ethylene cracker bottom with C9 heavier (fraction having a carbon number of 9 or more recovered from a reformed oil obtained through a reforming reaction of naphtha) and subjecting to hydrogenation, alkylation of naphthalene, dinucleation of single ring aromatic compounds, or the like. However, these methods generally have a problem in that the production cost is high.

On the other hand, it has been reported to produce a fraction containing aromatic components by catalytic reforming of kerosine fraction (Journal of The Japan Petroleum Institute, Vol. 13, No. 6 (1970), pp 468-474). In the reforming reaction of kerosine fraction, however, severe reaction conditions should be taken for obtaining solvents having a boiling point range of 185°-245° C. and a mixed aniline point of not higher than 21° C., particularly a solvent having a boiling point range of 205°-245° C. and a mixed aniline point of not higher than 18° C. Consequently, the catalyst life becomes very short and there is a problem in the industrial production.

SUMMARY OF THE INVENTION

It is, therefore, an object of the invention to solve the aforementioned problems and to provide a method of producing high-boiling point and high aromatic-content solvents having a desirable mixed aniline point and an excellent solubility at a cheap production cost.

The inventors have made studies in light of the above problems and confirmed that it is difficult to decrease the mixed aniline point of the fraction having a boiling point range of 185°-245° C. to not higher than 21° C. even by subjecting the kerosine fraction to the reforming reaction as it is, but it has surprisingly been found that the mixed aniline point of the fraction having a boiling point range of 185°-245° C. can easily be decreased to not higher than 21° C. when a fraction having a boiling point range of 150°-215° C. is subjected to a reforming reaction.

The invention is based on the above knowledge and lies in a method of producing a high aromatic-content solvent, which comprises subjecting a petroleum fraction containing at least 50% by volume of components having a boiling point range of 150°-215° C. to a reforming reaction and then subjecting the resulting product oil to a fractional distillation to recover a fraction having a boiling point range of 185°-245° C.

In a preferred embodiment of the invention, the petroleum fraction is a fraction obtained by fractional distillation of a kerosine fraction or a raffinate after the recovery of normal paraffin from the kerosine fraction.

In another preferred embodiment of the invention, a high aromatic-content solvent having a boiling point range of 185°-220° C. is obtained by subjecting a petroleum fraction containing at least 50% by volume of components having a boiling point range of 150°-195° C. to a reforming reaction.

In a further preferred embodiment of the invention, a high aromatic-content solvent having a boiling point of 205°-245° C. is obtained by subjecting a petroleum fraction containing at least 50% by volume of components having a boiling point range of 185°-215° C. to a reforming reaction.

DESCRIPTION OF THE PREFERRED EMBODIMENTS

The term "petroleum fraction containing components having a boiling point range of 150°-215° C." used in the invention means a fraction containing components distilled within the above temperature range through fractional distillation. As such a petroleum fraction, use may be made of straight-run fraction obtained through distillation of crude oil or kerosine fraction, fractions having the above boiling point range and obtained by thermal cracking, catalytic cracking, hydrocracking, alkylation or other refining treatment of petroleum fractions or residues and the like. The petroleum fraction contains at least 50% by volume of components distilled within a temperature range of 150°-215° C. If the amount of such components is less than 50% by volume, the yield of the fraction having a boiling point range of 185°-245° C. considerably decreases and the mixed aniline point can not be decreased to not higher than 21° C. Particularly, when the petroleum fraction contains at least 50% by volume of components having a boiling point range of 185°-215° C., a solvent having a boiling point range of 205°-245° C. and a mixed aniline point of not higher than 18° C. can be obtained. Also, if a solvent having a boiling point range of 185°-220° C. and a mixed aniline point of not higher than 21° C. is desired, it is preferred to use a fraction containing at least 50% by volume of components having a boiling point range of 150°-195° C. as the petroleum fraction.

The petroleum fraction containing at least 50% by volume of components having the above-described boiling point range can simply be obtained by cutting a kerosine fraction distilled at distillation step of crude oil in the petroleum refining at a temperature of not higher than 215° C., which is preferably adopted in the invention. Furthermore, a raffinate obtained after the recovery of normal paraffin from the kerosine fraction can be used instead of the above kerosine fraction. The recovery of normal paraffin can be carried out by an adsorption separation with a molecular sieve, such as by the Iso-Siv method (cf. *Hydrocarbon Processing*, 59, No. 5, May, 1980, pp. 110-114), the Molex method (cf. D. B. Broughton et al., *Petrol. Refiner.*, 40(5), 173 (1961), and the BP method (cf. A. A. Yeo et al., *Six World Petroleum Congress*, Sect. 1V-Paper 15 (1963)), a separation with urea aduct method or the like. Preferably, a raffinate by-product from a process for the production of normal paraffin as a starting material for detergents can be used. It is favorable to use a raffinate obtained after normal paraffin is recovered from the kerosine fraction in an amount of 50–95% by weight. The use of the raffinate cut at a temperature of not higher than 215° C. considerably increases the solvent having a boiling point range of 185°–245° C. as compared with the use of the above cut kerosine fraction, and can considerably decrease the mixed aniline point of such a solvent.

In the petroleum fraction as a starting material for the reforming reaction, each of sulfur and nitrogen contents is preferable to be not more than 50 ppm from a viewpoint of the prevention on the poisoning of catalyst. This is achieved by a generally used hydrodesulfurization method under usual conditions. For example, the petroleum fraction is subjected to hydrodesulfurization at a temperature of 250°–430° C., a pressure of 10–200 kgf/cm$^2$, a liquid hourly space velocity (LHSV) of 0.1–15/hr and a hydrogen recycling amount of 50–1400 Nm$^3$/kl by using a catalyst obtained by carrying at least one of cobalt, nickel, molybdenum, tungsten and the like on a carrier such as alumina, silica/alumina or the like. Such a hydrodesulfurization may be carried out after the preparation of the petroleum fraction containing at least 50% by volume of components having a boiling point range of 150°–215° C., but it is preferable to prepare the petroleum fraction by using the previously hydrodesulfurized material in view of the production efficiency.

As the reforming reaction, there can generally be adopted a catalytic reforming method widely used as a method of producing high-octane value gasoline from naphtha fraction or the like. In this case, the reforming of the petroleum fraction can be carried out at a temperature of 400°–550° C., a pressure of 1–50 kgf/cm$^2$, LHSV of 0.1–3/hr and a mol ratio of hydrogen to oil of 0.5–20 by using a catalyst obtained by carrying platinum or platinum and at least one of rhenium, germanium, tin, iridium, ruthenium and the like on alumina as a carrier.

As the other reforming reaction, the petroleum fraction can be reformed at a temperature of 250°–700° C., a pressure of 1–100 kgf/cm$^2$, LHSV of 0.1–20/hr and a mol ratio of hydrogen to oil of 0.5–20 by using an acidic refractory such as molecular sieve, crystalline aluminosilicate, silica, alumina, zirconia, titania, chromia, solid phosphoric acid, oxide of indium, lanthanum, manganese, cerium or tin or a mixture thereof, or a catalyst obtained by including or carrying a metal such as platinum, paradium, rhenium or the like in the above acidic refractory.

In the reforming reaction, a reaction apparatus in which a reactor portion is a fixed bed may be used, but the use of a reaction apparatus of moving bed provided with a continuously catalyst reproducing means is favorable in view of the efficiency.

The resulting product oil is distilled to recover a fraction having a boiling point range of 185°–245° C., whereby high aromatic-content solvents having a mixed aniline point of not higher than 21° C., preferably not higher than 18° C. can be obtained as a product.

The following examples are given in illustration of the invention and are not intended as limitations thereof.

EXAMPLES 1–2, COMPARATIVE EXAMPLE 1

As a starting material, there were provided a full fraction obtained by hydrodesulfurizing kerosine fraction, a fraction obtained by cutting the kerosine full fraction at a temperature of 195° C., and a fraction obtained by cutting at a temperature of 195° C. a raffinate obtained after 90% by weight of normal paraffin was recovered from the kerosine fraction with a molecular sieve, each of which fractions had characteristics shown in the following Table 1. Then, each of these starting materials was subjected to a reforming reaction at a temperature of 490° C., a pressure of 25 kgf/cm$^2$, LHSV of 0.8/hr and a mol ratio of hydrogen to oil of 6 by using a catalytic reforming catalyst carried 0.2% by weight of platinum on alumina carrier. The resulting product oil had properties shown in the following Table 2 and was subjected to a fractional distillation to obtain a fraction having a boiling point range of 195°–215° C.

TABLE 1

| Kind of oil Fraction | Kerosine full fraction | Kerosine 195° C. lighter | Raffinate 195° C. lighter |
|---|---|---|---|
| Specific gravity (15/4° C.) | 0.7926 | 0.7731 | 0.9840 |
| Viscosity (cst, 30° C.) | 1.420 | 1.025 | 1.337 |
| Total nitrogen content (ppm) | ≦0.5 | ≦0.5 | ≦0.5 |
| Sulfur content (ppm) | ≦0.1 | ≦0.1 | ≦0.1 |
| Aniline point (°C.) | 66.4 | 59.3 | 57.6 |
| Composition (vol %) | | | |
| saturated content | 93.5 | 92.4 | 87.2 |
| unsaturated content | 0.5 | 0.5 | 0.5 |
| aromatic content | 6.0 | 6.0 | 12.3 |
| Distillation characteristics | | | |
| initial boiling point (°C.) | 181.5 | 181.5 | 188.0 |
| 50% distillation point (°C.) | 210.5 | 190.0 | 193.0 |
| 95% distillation point (°C.) | 243.0 | 202.0 | 203.0 |
| end point (°C.) | 256.0 | 205.0 | 206.0 |
| Fraction having a boiling point of 150–195° C. (vol %) | 18 | 95 | 96 |

TABLE 2

| Kind of oil Fraction | Example 1 kerosine 195° C. lighter | Example 2 raffinate 195° C. lighter | Comparative Example 1 kerosine full fraction |
|---|---|---|---|
| Properties of product oil | | | |
| specific gravity (15/4° C.) | 0.9038 | 0.9063 | 0.8789 |
| mixed aniline point (°C.) | 20.8 | 19.8 | 29.0 |
| distillation characteristics | | | |
| initial boiling point (°C.) | 189.5 | 190.0 | 189.5 |
| 50% distillation point (°C.) | 201.0 | 201.0 | 203.0 |
| 95% distillation point (°C.) | 209.5 | 211.0 | 210.0 |
| dry point (°C.) | 220.5 | 221.0 | 220.0 |
| color (Saybolt) | +30 | +30 | +30 |
| copper corrosion test | 1a | 1a | 1a |
| total acid value (mgKOH/g) | 0.00 | 0.00 | 0.00 |
| flash point (°C.) | 73 | 75 | 74 |

TABLE 2-continued

| Kind of oil<br>Fraction | Example 1<br>kerosine<br>195° C. lighter | Example 2<br>raffinate<br>195° C. lighter | Comparative<br>Example 1<br>kerosine<br>full fraction |
|---|---|---|---|
| aromatic content (wt %) | 97.6 | 97.8 | 95.4 |
| Yield of fraction having a boiling point of 195-215° C. (%) | 23.0 | 27.2 | 16.2 |

EXAMPLES 3-4, COMPARATIVE EXAMPLE 2

As a starting material, there were provided the same full fraction having characteristics shown in Table 1 as used in Example 1, a fraction obtained by cutting the kerosine full fraction at a temperature of 185°-215° C., and a fraction obtained by cutting at a temperature of 185°-215° C. a raffinate obtained after 90% by weight of normal paraffin was recovered from the kerosine fraction with a molecular sieve, each of the latter two fractions had characteristics shown in the following Table 3. Then, each of these starting materials was subjected to a reforming reaction under the same conditions as described in Example 1. The resulting product oil had properties shown in the following Table 4 and was subjected to a fractional distillation to obtain a fraction having a boiling point range of 215°-235° C.

TABLE 3

| Kind of oil<br>Fraction | Kerosine<br>185 ~ 215° C. | Raffinate<br>185 ~ 215° C. |
|---|---|---|
| Specific gravity (15/4° C.) | 0.7896 | 0.8008 |
| Viscosity (cst, 30° C.) | 1.232 | 1.468 |
| Total nitrogen content (ppm) | ≦0.5 | ≦0.5 |
| Sulfur content (ppm) | ≦0.1 | ≦0.1 |
| Aniline point (°C.) | 63.2 | 59.6 |
| Composition (vol %) | | |
| saturated content | 93.8 | 88.4 |
| unsaturated content | 0.4 | 0.6 |
| aromatic content | 5.8 | 11.0 |
| Distillation characteristics | | |
| initial boiling point (°C.) | 181.5 | 188.0 |
| 50% distillation point (°C.) | 201.0 | 204.5 |
| 95% distillation point (°C.) | 218.0 | 219.0 |
| end point (°C.) | 223.0 | 224.0 |
| Fraction having a boiling point of 185-215° C. (vol %) | 93.0 | 94.0 |

TABLE 4

| Kind of oil<br>Fraction | Example 3<br>kerosine<br>185 ~ 215° C. | Example 4<br>raffinate<br>185 ~ 215° C. | Comparative<br>Example 2<br>kerosine<br>full fraction |
|---|---|---|---|
| Properties of product oil | | | |
| specific gravity (15/4° C.) | 0.9610 | 0.9624 | 0.9368 |
| mixed aniline point (°C.) | 17.6 | 16.8 | 25.0 |
| distillation characteristics | | | |
| initial boiling point (°C.) | 215.0 | 217.0 | 214.0 |
| 50% distillation point (°C.) | 222.0 | 224.0 | 226.0 |
| 95% distillation point (°C.) | 231.0 | 232.0 | 228.0 |
| dry point (°C.) | 235.0 | 235.0 | 236.0 |
| color (Saybolt) | +30 | +30 | +30 |
| copper corrosion test | 1a | 1a | 1a |
| total acid value (mgKOH/g) | 0.00 | 0.00 | 0.00 |
| flash point (°C.) | 88 | 90 | 87 |
| aromatic content (wt %) | 98.7 | 98.9 | 96.7 |
| Yield of fraction having a boiling point of 215-235° C. (%) | 19.0 | 21.3 | 17.5 |

As seen from the above results, when the petroleum fraction containing components having a boiling point range of 150°-215° C. is subjected to the reforming reaction, solvents having a mixed point lower than that of the case of reforming the kerosine fraction itself are obtained.

As mentioned above, according to the invention, the petroleum fraction containing at least 50% by volume of components having a boiling point range of 150°-215° C., particularly 150°-195° C. or 185°-215° C. is subjected to reforming reaction, whereby high aromatic-content solvents having a low mixed aniline point and an excellent solubility can be obtained in a cheap production cost.

What is claimed is:

1. A method of producing a high aromatic-content solvent, which comprises subjecting a petroleum fraction containing at least 50% by volume of components having a boiling point range of 150°-215620 C. to a reforming reaction and then subjecting the resulting product oil to a fractional distillation to recover a fraction having a mixed aniline point of not higher than 21° C. and a boiling point range of 185°-245° C.

2. The method according to claim 1, wherein said petroleum fraction contains at least 50% by volume of components having a boiling point range of 185°-215° C. and is reformed to obtain a fraction having a mixed aniline point of not higher that 18° C. and a boiling point range of 205°-245° C.

3. The method according to claim 1, wherein said petroleum fraction contains at least 50% by volume of components having a boiling point range of 150°-195° C. and is reformed to obtain a fraction having a mixed aniline point of not higher than 21° C. and a boiling point range of 185°-220° C.

4. The method according to claim 1, wherein said petroleum fraction is a fraction obtained by fractional distillation of a kerosine fraction.

5. The method according to claim 1, wherein said petroleum fraction is a raffinate after the recovery of normal paraffin from a kerosine fraction.

6. The method according to claim 5, wherein the raffinate is a rafinate resulting from the recovery of at least 50% by weight of normal paraffins from the kerosine fraction.

7. The method according to claim 1, wherein the reforming reaction is carried out by the use of a catalyst prepared by supporting platinum alone or in combination with rhenium, geranium, tin, iridium, or rhutenium on an alumina carrier and under the conditions of temperature range of from 400° to 550° C., pressure range of from 1 to 100 kg/cm$^2$, liquid hourly space velocity range of from 0.1 to 3 hr$^{-1}$, and hydrogen/oil molar ratio range from 0.5 to 20.

8. The method according to claim 1, wherein the reforming reaction is carried out by the use of a catalyst comprising at least one acidic refractory selected from the group consisting of a molecular sieve, crystalline aluminosilicate, silica, alumina, zirconia, titania, chromia, solid phosphoric acid, and oxides of indium, lanthanum, maganese, cerium, or tin; or a catalyst prepared by including or carrying therein or thereon a metal selected from the group consisting of platinum, palladium, and rhenium; under the conditions of a temperature range of from 250° to 700° C., a pressure range of from 1 to 100 kg/cm$^2$, a liquid hourly space velocity range of from 0.1 to 20hr$^{-1}$, and a hydrogen/oil molar ratio range of from 0.5 to 20.

9. The method according to claim 7, wherein the catalyst for the reforming reaction is a catalyst for catalytic reforming of naphtha.

* * * * *